United States Patent [19]

Schultze et al.

[11] 4,162,072

[45] Jul. 24, 1979

[54] BALL GAME APPARATUS COMPRISING A FRAME TO WHICH A MESH OR FABRIC IS ATTACHED

[75] Inventors: Volker Schultze; Paul Ayasse, both of Renchen, Fed. Rep. of Germany

[73] Assignee: Volker Schultze Elektro-mechanische Apparate, Fed. Rep. of Germany

[21] Appl. No.: 788,541

[22] Filed: Apr. 18, 1977

[30] Foreign Application Priority Data

Aug. 27, 1976 [DE] Fed. Rep. of Germany ..... 2638574

[51] Int. Cl.[2] ..... A63B 65/12

[52] U.S. Cl. ..... 273/96 R

[58] Field of Search ..... 273/67 R, 73 R, 96 R; 124/16; 272/65, 67, 135

[56] References Cited

U.S. PATENT DOCUMENTS

| | | | |
|---|---|---|---|
| 898,350 | 9/1908 | Foster | 273/96 R |
| 1,170,948 | 2/1916 | Achershaug | 273/96 R |
| 1,463,726 | 7/1923 | Ruttmann | 273/96 R |
| 2,224,453 | 12/1940 | Hansen | 273/96 R |
| 2,465,808 | 3/1949 | Killam | 273/96 R |
| 3,080,850 | 3/1963 | Schrougham | 273/96 R X |
| 3,342,491 | 9/1967 | Padovani | 273/96 R |
| 3,905,600 | 9/1975 | Bourdamis | 273/96 R |
| 3,931,971 | 1/1976 | Harvey | 273/96 R X |
| 4,047,717 | 9/1977 | De Angelis | 273/96 R X |

FOREIGN PATENT DOCUMENTS

| | | | |
|---|---|---|---|
| 29894 | 6/1922 | Denmark | 273/96 R |
| 223960 | 7/1910 | Fed. Rep. of Germany | 273/96 R |
| 565654 | 12/1932 | Fed. Rep. of Germany | 273/96 R |
| 2423421 | 11/1975 | Fed. Rep. of Germany | 273/96 R |
| 821508 | 8/1937 | France | 273/96 R |
| 211372 | 2/1924 | United Kingdom | 273/96 R |

*Primary Examiner*—Richard J. Apley

*Attorney, Agent, or Firm*—Craig and Antonelli

[57] ABSTRACT

A hand-held playing device akin to a racket comprises a frame to which a mesh or fabric is attached. In the illustrated device the frame is generally rectangular and the shorter sides or ends of the frame are formed as handles. The side members of the longer sides are both jointed at the middle so that the frame can be kinked or folded about a transverse axis. A ball is thrown from the device by straightening the frame suddenly from the kinked position to the extended position. The joints can be hinged, with or without spring biasing to the extended position and with or without a stop abutment after the manner of an elbow joint. More simply, the joints can be constituted by helical springs joining the respective pairs of parts of the side members.

18 Claims, 3 Drawing Figures

BALL GAME APPARATUS COMPRISING A FRAME TO WHICH A MESH OR FABRIC IS ATTACHED

The invention relates to ball game apparatus for the pitching, throwing or striking of balls, comprising a frame to which a mesh or fabric is attached.

Ball game apparatus of this kind is generally known in the form of tennis rackets. The racket for the perlota game commonly found in the Basque provices of Spain and France can also be included in this kind. In both kinds of rackets a fairly long handle acts on the frame with the object of imparting a considerable force to the blows which are applied to the ball. For this reason the construction of the racket naturally has a decisive influence on the entire ambit of the game including the shape and size of the games area as well as the rules of the game. It is generally known that the game of tennis offers the facility for intensive physical movement but also makes substantial requirements regarding the size of the games area. Similar considerations probably apply to the pelota game.

It is an object of the invention to provide ball game apparatus which calls for substantially smaller games area although offering the same facilities for intensive movement. This can be achieved by reducing the force of the blows which are applied to the ball: however, since it is intended that the human body shall have the same opportunity of physical exercise as in the above-mentioned games, such an objective can be attained only by a different playing method based on a corresponding design of the ball game apparatus in which less kinetic energy is imparted to the ball.

In ball game apparatus of the kind described hereinbefore this object is attained according to the invention in that two side members of the frame of longitudinally and transversely symmetrical construction are interrupted in the longitudinal middle and that the two parts of the side members are connected to each other by means of a joint. This design of the ball game apparatus provides the condition for a different method of playing. The joint arrangement enables the two halves of the apparatus to bend about the middle transverse joint axis into a kinked position or allows the two halves to return from such position into the extended position. This results in a method of playing in which an arriving ball, which strikes the mesh or fabric, can be caught by bending into the kinked position, while return to the extended position enables the ball to be thrown upwardly or in some other direction. It is obvious that with the same applied force the range of the ball will be less than, for example, in the case of tennis.

Irrespective of this consideration, which applies to a competitive game such as tennis, ball game apparatus embodying the invention can be used in many different ways with a correspondingly arranged method of playing, for example by single persons, with or without a wall as a game partner, or by two or more persons as a competitive game with any desired rules. For example, it permits a method of playing similar to punch-ball or volley-ball in which the ball must be projected over a line or net by two groups playing opposite each other.

The joint may be constructed in the manner of a hinged joint comprising two arms which can move relatively to each other about a joint pin, the two arms being mounted on the two parts of a side member. The hinged joint can be provided in the manner of a universal joint with a stop abutment for the extended position. It can also be provided with a correspondingly constructed spring which tends to force the joint into the extended position. The outward pivoting process, which is to be performed manually, is assisted by this spring biasing so as to take place suddenly and at the same time to act resiliently on the forearms.

In a preferred but nevertheless simple embodiment, the joint is constituted by a coaxial helical spring, which interconnects the two side member parts. The helical spring permits the two side member parts to pivot against each other but always tends to return to the extended position and thus also assists the process of straightening into the extended position and therefore the pitching of the ball.

The external shape of the ball game apparatus in terms of choice of material and shape thereof is largely a matter for the manufacturer. The frame can be constructed of wood, reinforced plastics or metal; it can have a rectangular or round cross-section or some other profile; and it can be constructed of solid material or tubular material. The attached covering can be mesh or an imperforate fabric and can be tightly tensioned or slack to a greater or lesser degree. Numerous variations are also possible as regards the shape of the frame: it can be rectangular, circular or oval; an elongated rectangular or oval shape is to be preferred. The frame parts which are situated opposite each other, and symmetrically to the axis of the joint, can be formed into handles; or separate attached handles can be provided at these places.

One preferred embodiment of the subject-matter of the invention will now be described, by way of example, with reference to the accompanying drawings, in which.

Figure 1:
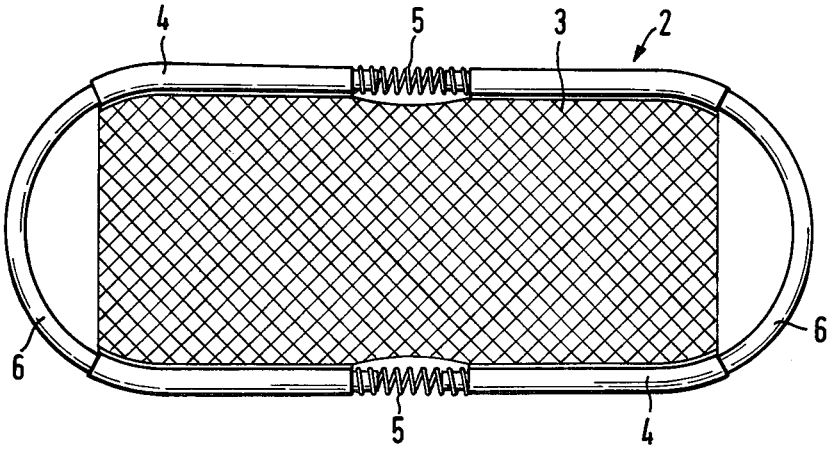
FIG. 1 shows the embodiment of ball game apparatus, in the extended position, in a plan view.

The ball game apparatus shown in the drawings substantially comprises a peripheral elongated oval frame 2, which can be constructed of suitably curved wooden strips in the manner of a tennis racket, of Tonkin bamboo or the like, of reinforced plastics or sectional metal rods or metal tubes, and a covering 3, namely a mesh or fabric comprising, for example, plastics filaments of polyamides or polyurethanes. The two side members 4 of the frame are interrupted in their longitudinal middle and the two parts of each of these are joined to each other by means of a helical spring 5. The frame 2, consisting of metal tube in the illustrated embodiment, is curved at the two narrow sides and, since the covering is recessed at the said curved portions, these function as handles 6.

The two coil springs 5 function as respective joints for the pairs of parts of the two side members 4, and therefore for the two parts of the frame 2, and enable the two parts of the frame to be pivoted relatively to each other from the extended position to a kinked position and to be returned thereto from the kinked position, by pulling on the handles 6. While the coil springs 5 have an inhibiting action in the first part of the motion—establishing the kinked position—and the resistance of the said springs must be overcome, they have an assisting action in the second part of the motion—establishing the extended position—with a rapid-action effect.

Figure 2:
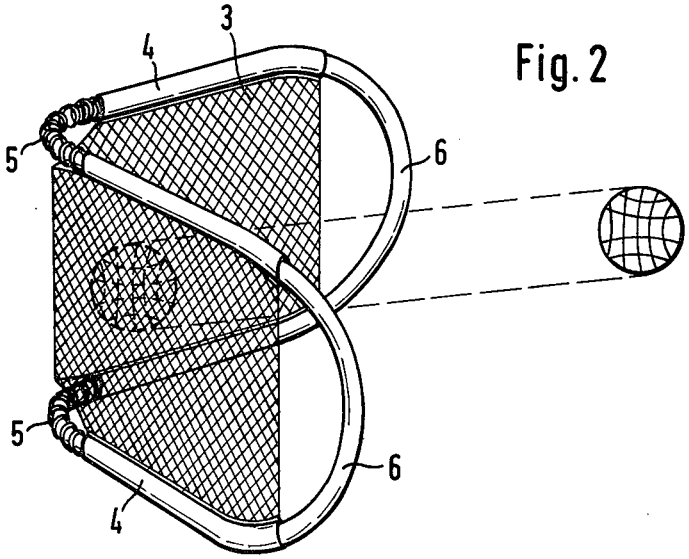
FIG. 2 shows the embodiment of FIG. 1 in the pivoted state, in use, in a perspective side view.

The method of operation of the ball game apparatus can be understood more particularly from FIG. 2. The apparatus is held in both hands and is bent into a kinked position and then the ball placed thereon is thrown upwardly or against a wall or towards another person by suddenly changing into the extended position, an action in which the coil springs 5 participate powerfully. A dropping or arriving ball is caught in the reverse sense by bending of the ball game apparatus.

The apparatus permits the most diverse kinds of ball games to be performed by single persons or several persons, including group games with predetermined rules, somewhat like punch-ball or volley-ball.

Figure 1A:
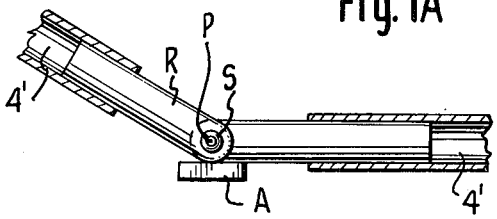
FIG. 1A is an enlarged schematic view showing an alternate embodiment of hinge connection for the ball game apparatus.

A hinged joint comprising two short metal rails R connected to each other by means of a joint pin P and mounted on the two parts of the side members 4' could be used (FIG. 1A) in place of the coil spring 5 which is used in the illustrated embodiment of FIGS. 1 and 2. If the side members comprise tubes 4', the metal rails R can also comprise round pieces which are inserted into the tubes by interference fit. A hinged joint of this kind can also be provided with a stop abutment A for the extended position in the manner of an elbow joint to permit pivoting to only one side. It can also be biased by a spring S which tends to force it into the extended position.

What is claimed is:

1. Ball game apparatus for pitching, throwing or striking of balls, comprising:

a first relatively rigid frame part, a second relatively rigid frame part, flexible mesh means connected to and carried by said first and second frame parts, handle means at each of said first and second frame parts, and hinge means hingedly interconnecting said first and second frame parts for accommodating movement of said frame parts between an extended position and a kinked position so that a ball can be propelled from the surface of the mesh means upon movement of said frame parts from said kinked to said extended positions, said hinge means including resilient means continuously biasing said first and second frame parts toward said extended position so that ball throwing movement of said frame parts is aided by said resilient means.

2. Apparatus according to claim 1, further comprising a ball formed separately of said mesh means and being propellable from the surface of the mesh means upon said movement of said frame parts from said kinked to said extended positions.

3. Apparatus according to claim 1, wherein each of said frame parts includes a pair of longitudinally extending side members joined by a transversely extending end part, and wherein said hinge means includes tightly wound helical springs surrounding respective mutually facing ends of the side members.

4. Apparatus according to claim 3, wherein the longitudinal length of the frame parts is greater than the transverse dimension thereof, and wherein said end parts are formed into handles.

5. Apparatus according to claim 4, wherein the resilient means is formed separately of said mesh means and is attached to said frame parts at positions spaced from said mesh means.

6. Apparatus according to claim 5, further comprising a ball formed separately of said mesh means and being propellable from the surface of the mesh means upon said movement of said frame parts from said kinked to said extended positions.

7. Apparatus according to claim 6, wherein said mesh means is connected to said longitudinally extending side members so that said mesh means is maintained substantially in the planes of the respective frame parts connected thereto during movement of said frame parts between said kinked and extended positions.

8. Apparatus according to claim 3, wherein said mesh means is connected to said longitudinally extending side members so that said mesh means is maintained substantially in the planes of the respective frame parts connected thereto during movement of said frame parts between said kinked and extended positions.

9. Apparatus according to claim 1, wherein the resilient means is formed separately of said mesh means and is attached to said frame parts at positions spaced from said mesh means.

10. Apparatus according to claim 1, wherein said hinge means includes rail means at each of said frame parts and joint pin means attaching said rail means.

11. Apparatus according to claim 10, wherein said hinge means further comprises a stop abutment which permits pivoting of said frame parts to only one side of said extended position.

12. Apparatus according to claim 11, further comprising a ball formed separately of said mesh means and being propellable from the surface of the mesh means upon said movement of said frame parts from said kinked to said extended positions.

13. Apparatus according to claim 1, wherein said hinge means further comprises a stop abutment which permits pivoting of said frame parts to only one side of said extended position.

14. Apparatus according to claim 1, wherein each of said frame parts includes a pair of longitudinally extending side members joined by a transversely extending end part, and wherein said mesh means is connected to said longitudinally extending side members so that said mesh means is maintained substantially in the planes of the respective frame parts connected thereto during movement of said frame parts between said kinked and extended positions.

15. A method of pitching, throwing or striking balls with an apparatus of the type having:

a first relatively rigid frame part, a second relatively rigid frame part, flexible mesh means connected to and carried by said first and second frame parts, handle means at each of said first and second frame parts, and hinge means hingedly interconnecting said first and second frame parts for accommodating movement of said frame parts between an extended position and a kinked position so that a ball can be propelled from the surface of the mesh means upon movement of said frame parts from said kinked to said extended positions, said hinge means including resilient means continuously biasing said first and second frame parts toward said extended position so that ball throwing movement of said frame parts is aided by said resilient means; said method comprising:

manually moving said first and second frame parts to a kinked position against the force of said resilient means with a ball disposed in contact with said mesh means, and subsequently moving said first and second frame parts to said extended position with the aid of said resilient means, with a consequent propelling of said ball from the surface of the mesh means.

16. A method according to claim 15, wherein each of said frame parts includes a pair of longitudinally extending side members joined by a transversely extending end part, and wherein said hinge means includes tightly wound helical springs surrounding respective mutually facing ends of the side members.

17. The method according to claim 16, wherein said mesh means is connected to said longitudinally extending side members, and wherein said manually moving said parts to a kinked position and said subsequently moving said parts to said extended position includes maintaining said mesh means connected to said longitudinally extending side members to move in the plane of the respective side members.

18. A method according to claim 15, wherein said hinge means further comprises a stop abutment which permits pivoting of said frame parts to only one side of said extended position.

* * * * *